United States Patent [19]

Silvestri, Jr.

[11] Patent Number: 4,940,383

[45] Date of Patent: Jul. 10, 1990

[54] SYSTEM FOR ADMITTING STEAM INTO A TURBINE

[75] Inventor: George J. Silvestri, Jr., Winter Park, Fla.

[73] Assignee: Westinghouse Electric Corp., Pittsburgh, Pa.

[21] Appl. No.: 383,391

[22] Filed: Jul. 21, 1989

[51] Int. Cl.[5] ..... F01D 17/18

[52] U.S. Cl. ..... 415/44; 415/1; 415/148; 60/646

[58] Field of Search ..... 415/1, 148, 149.1, 149.2, 415/150, 182.1, 182, 202, 108, 43, 44, 45; 137/883; 60/646, 657

[56] References Cited

U.S. PATENT DOCUMENTS

| | | | |
|---|---|---|---|
| 4,325,670 | 4/1982 | Silvestri, Jr. | 415/1 |
| 4,570,677 | 2/1986 | Roxton et al. | 137/883 |
| 4,604,028 | 8/1986 | Yeaple et al. | 415/44 |
| 4,642,025 | 2/1987 | Heiniger et al. | 415/202 |
| 4,850,793 | 7/1989 | Silvestri, Jr. et al. | 415/44 |

FOREIGN PATENT DOCUMENTS

| | | | |
|---|---|---|---|
| 0038605 | 2/1988 | Japan | 415/202 |

*Primary Examiner*—Robert E. Garrett
*Assistant Examiner*—Hoang M. Nguyen

[57] ABSTRACT

A steam turbine in which the number of shell penetrations is reduced to six, without the use of T or Y fittings, by controlling steam flow to large nozzle chambers with a single large valve, rather than two smaller size valves. Secondly, adjacent valves are oriented in opposite directions, with those valves controlling nozzle chambers in the upper casing of the turbine opening to provide downward flow. This arrangement achieves two benefits: first, it reduces the number of turns and the length of the "spaghetti" piping leading to the nozzle inlet snouts, providing a straighter and more direct route for steam flow; and secondly, the inversion of adjacent valves allows room for installation of individual servomotors for each valve, which in turn enables greater flexibility in valve actuation sequencing. The invention also provides an improved method of valve sequencing.

8 Claims, 4 Drawing Sheets

SYSTEM FOR ADMITTING STEAM INTO A TURBINE

BACKGROUND OF THE INVENTION

This invention relates to steam turbines and, more particularly, to a method and apparatus for admitting steam into a steam turbine to improve turbine efficiency and at the same time reduce equipment costs relating thereto.

In general, steam flow is directed into large turbines through multiple arcuate nozzle chambers disposed circumferentially in both upper and lower turbine casings. Steam admission into the nozzle chambers is regulated by valves grouped in steam chests with the valves opening to admit steam from the steam chests into the nozzle chambers though "spaghetti" piping, and closing to obstruct the flow thereto. Variations in turbine design include full-arc admission units in which every first stage nozzle is active at all load conditions, and partial-arc units in which the number of active first stage nozzles is varied in response to load changes.

More efficient control of turbine output under varying load conditions has been realized by the partial-arc admission designs wherein the inlet nozzles are separated into discrete groups and are contained in individual chambers. Relatively high efficiency is attainable by sequentially admitting steam through individual nozzle chambers with a minimum of throttling, rather than by throttling the entire arc of admission. Typically, steam control valves modulate together when multiple valves are used to regulate steam flow into a single nozzle chamber.

According to well-established principles of thermodynamics, it is theoretically demonstrable that maximum turbine efficiency for changing load conditions can be attained from the use of an infinite number of valve points. A valve point is defined as a state of steam admission in which one or more of the valves are either in the completely open or completely closed position. Maximum efficiency would therefore require an infinite number of valves. As turbine load increases or decreases, valves would open or close to provide or subtract infinitesimal increments of steam flow to the nozzle chambers. Aside from the practical impossibility of providing an infinite number of valves with corresponding pipes, inlets, etc., a large number of valves is not economically feasible. Each additional turbine shell penetration with its inlet snout, each conduit and each valve, substantially increase the equipment cost. In practice, control valves for a given turbine element usually number from four to eight.

Efforts to achieve the optimum compromise between improved turbine efficiency and increasing capital cost for increasing numbers of valves typically focus on two aspects which are interrelated. One of these involves reducing the number of shell penetrations. The other focus is to maintain the optimum number of valve points utilizing various valve activation sequences.

With respect to the first of the foregoing considerations, a comparison of eight-valve designs, having eight inlets to the nozzle chambers, with a four-valve design having four valves and four inlet snouts, reveals that the shell and nozzle chamber diameters are larger on the eight-valve designs. This results in thicker pressure vessel walls, heavier bolting and more weight which, in turn, result in increased costs of the turbine shell, the steam chests and the inlet piping.

Some eight-valve designs typically have six nozzle chambers in two sizes, a large central chamber and two smaller outboard chambers in each of the upper and lower casings. These are supplied by two steam chests, one to the left and one to the right. The larger nozzle chambers have two inlets connected to separate lines from each steam chest. As mentioned hereinabove, the valves supplying such chambers with more than one inlet will typically modulate in unison. Other designs have utilized a Y fitting to connect the two lines from the separate steam chests to a single large inlet snout for each central chamber. On later designs, a T fitting has been used to join the separate lines to the large cover chamber. These fittings reduce the number of shell penetrations and make possible the same shell and nozzle chamber diameters as the four-valve turbine designs, but, these fittings are expensive. It would thus be desirable to eliminate such features.

Another equipment consideration is that in existing installations, the inlet pipes to the nozzle chambers in the upper casing pass downward from the steam chest, turn 180°, and then lead upward. These turns in the piping are much more expensive than straight piping, and the elbows increase pressure losses. A prior solution involves inverting one of the steam chests and supplying all of the nozzle chambers in the upper casing from the inverted steam chest. But, this solution would create unbalanced piping forces, producing a turning moment on the turbine shell.

The second consideration has resulted in sequencing of the activation of nozzle chambers in order to maximize the number of valve points, while at the same time, compensating for energy loss and stresses on turbine blades when passing inactive nozzle chambers. When rotating blades leave an active arc of admission, the steam flowing from the active nozzle chambers must work on the stagnant steam to set it in motion again, resulting in decreased efficiency or displacement loss. If the sequence of activating or de-activating nozzle chambers is such that there is never more than one inactive nozzle area in the inner circumference of the turbine, i.e., two or more adjacent inactive chambers, it is known as single shock operation. Double shock operation involves two interruptions of the active arcs of steam admission, and doubling the displacement loss, theoretically, with a commensurate degradation in the heat rate. Hence, there has been a preference for single shock operation heretobefore.

A prior invention for an improved method of activating individual nozzle chambers to maximize turbine efficiency is disclosed in U.S. Pat. No. 4,325,670 to Silvestri, assigned to Westinghouse Electric Corporation. That method involves a sequence of activating and deactivating six nozzle chambers of two different sizes to increase the number of valve points, thereby reducing heat rate, i.e., increasing efficiency. Half of the chambers are initially activated to produce a 50% arc of admission. It has been demonstrated empirically that arcs of admission below 50% result in poorer thermal performance and higher thermal stress. The remaining chambers are then sequentially activated and deactivated to provide, in combination, valve points at 62.5%, 75%, 87.5% and 100% admission.

The following table presents the effect of double versus single shock in turbine heat rate between partial admission arcs of 75% and 87.5%:

| Throttle Flow | | Heat Rates, Btu/Kwh (KJ/Kwh) | |
|---|---|---|---|
| LB/hour | (Kg/hour) | Single Shock | Double Shock |
| 3,330,000 | (1510478) | 7919 (8354.9619) | 7920 (8356.0169) |
| 3,260,000 | (1478726.2) | 7920 (8356.0169) | 7923 (8359.1821) |
| 3,200,000 | (1451510.4) | 7919 (8354.9619) | 7922 (8358.127) |
| 3,130,000 | (1419758.6) | 7913 (8348.6315) | 7917 (8352.8518) |

In fact, because the jet of steam from an active nozzle chamber spreads out in the clearance space between the nozzle and the rotating blade at the boundary between active and inactive arcs of admission, and because side leakage flow moves into the inactive zone, displacement loss accompanying double shock operation would be less than twice that of single shock operation, where the inactive arcs are kept relatively small. It is desirable to eliminate expensive design features if this can be done without substantially diminishing thermal performance.

Furthermore, certain analyses have established that the stresses and forces resulting from operation at 75% admission with double shock are no higher and are probably lower than stresses at 50% admission and single shock operation on turbines with 2400 psig throttle pressure and side entry control stage blade roots.

SUMMARY OF THE INVENTION

Accordingly, among the several objects of this invention are modifications of certain steam inlet features to existing nozzle configurations and in conjunction therewith utilization of optimum valve sequencing in order to reduce heat rates, i.e., improve thermal efficiency, and at the same time, reduce cost of equipment; elimination of the Y and T fitting to the larger nozzle chambers; reduction of the actual number of valves without reducing the number of valve points; addition of another valve point to further reduce heat rate; and reduction of the amount of piping between steam chest and nozzle chamber.

The present invention accomplishes the above and other objects in a system which reduces the number of shell penetrations to six, without the use of T or Y fittings, by controlling steam flow to large nozzle chambers with a single large valve, rather than two smaller size valves and can be retrofitted into existing units to increase the number of valve points and decreases heat rate. Secondly, adjacent valves are oriented in opposite directions, with those valves controlling nozzle chambers in the upper casing of the turbine opening to provide upward flow. This arrangement achieves two benefits: first, it reduces the number of turns and the length of the "spaghetti" piping leading to the nozzle inlet snouts, providing a straighter and more direct route for steam flow; and secondly, the inversion of adjacent valves allows room for installation of individual servomotors for each valve, which in turn enables greater flexibility in valve actuation sequencing. The invention also provides an improved method of valve sequencing.

BRIEF DESCRIPTION OF THE DRAWINGS

For a better understanding of the present invention, reference may be had to the following detailed description taken in conjunction with the accompanying drawings in which.

DETAILED DESCRIPTION OF THE PREFERRED EMBODIMENT

Figure 1:
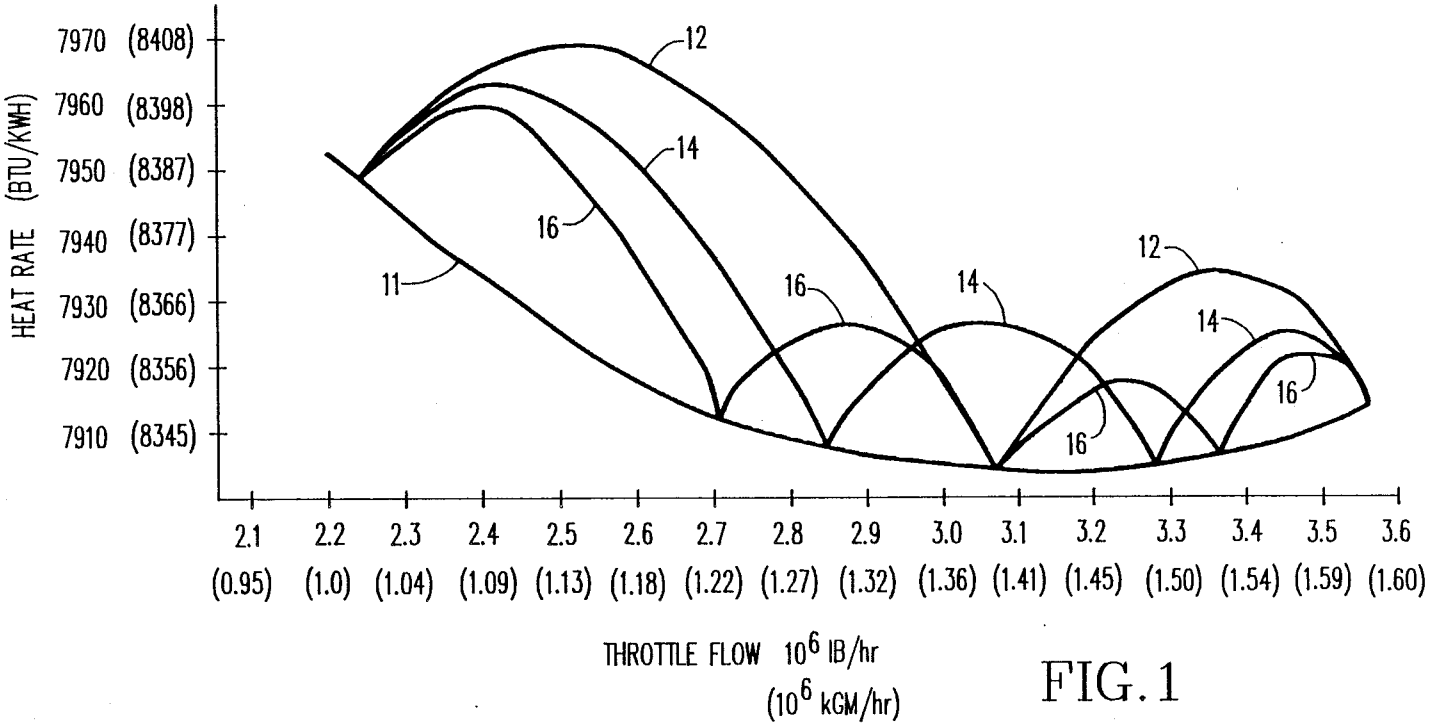
FIG. 1 is a graph on which are depicted several turbine designs for comparison purposes, plotting heat rate against rate of steam flow.

FIG. 1 is a plot of the turbine heat rate in BTU's per kilowatt hour versus steam throttle flow in million pounds per hour for an exemplary steam turbine showing five valve points between 50% and 100% admission. Curve 11, on this graph, is the locus of valve points assuming an infinite number of valves for the given turbine. Comparisons of several valve configurations in the load range from 50% admission to 100% admission can be seen from Curves 12, 14 and 16. Curve 12 has only one valve point between 50% and 100% admission, and its valve loops show a heat rate 24 Btu/kwh higher than Curve 14 which has an additional valve point at 87.5% admission. Curve 16 illustrates three possible valve points between 50% and 100%, i.e., at 62.5%, 75% and 87.5%, for an eight valve machine. However, because of the concern with double shock, the valves were actually operated such that the valve loops followed curve 16 up to about $3.1\times10^6$ lbs. steam/hr (75% admission) and then followed curve 12 from 75% to 100% admission. Furthermore, the prior systems were mechanical and hydraulic systems in which cycling of valves was not easily implemented. As can be seen from FIG. 1, the turbine heat rate increases and efficiency decreases as the number of valve points decreases.

Figure 2:
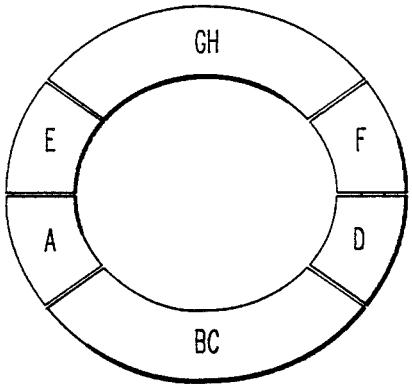
FIG. 2 shows a typical nozzle chamber arrangement for an exemplary turbine.

FIG. 2 is a simplified partial cross-sectional representation of a multi-chamber partial-arc turbine showing an arrangement of six nozzle chambers A, BC, D, E, F and GH for an exemplary turbine through which throttle steam passes and by which the steam is directed to the turbine blades. The chambers BC and GH represent twice the area of each of the chambers A, D, E and F. The normal sequence of nozzle chamber activation is to initially open steam control valves (not shown) to chambers A, BC and D together for an initial arc of admission at 50%. Then, as load increases, chamber E, chamber F and chamber GH are activated, respectively. When the activation of GH achieves a flow level corresponding to the intersection of the valve loop between 62.5% and 87.5% and the valve loop between 75% and 100%, the valve supplying either chamber E or chamber F is deactivated and the valves supplying chamber GH are opened wider. As the load continues to increase, the valves supplying GH open completely, for 87.5% admission. With further increasing load, the deactivated valve is reactivated for 100% admission. This procedure should result in a smaller valve loop between the 75% valve point and the 87.5% valve point.

An alternative method of activation comprises the initial step of activating a 50% arc of admission, followed by chamber E and then chamber F. When 75% admission is reached, chambers F and D, or A and E, are closed and the valves for chamber GH are opened. The turbine is still at 75% admission. This too results in a single shock operation in which there is only one interruption in the active arc of admission during one revolution.

The double shock sequences should also produce the smaller valve loop. Double shock involves two inactive zones and two active arcs of admission of the blade path in one revolution. In one of these, valves supplying chambers D and E or A and F are closed and chamber GH is activated at 75% admission. Then, the smaller chambers are reactivated sequentially with increasing load, as above. In the second procedure, either chambers E and F or chambers A and D would be inactivated at 75% admission and then sequentially activated. The first procedure with diametrically opposite inactive chambers results in less side thrust on the rotor.

Chambers BC and GH, in prior art designs, have been supplied by two valves each, with each pair modulating together. With the improvement of this invention, described hereinafter, these chambers would each have flow regulated by a single, larger valve.

Figure 3:
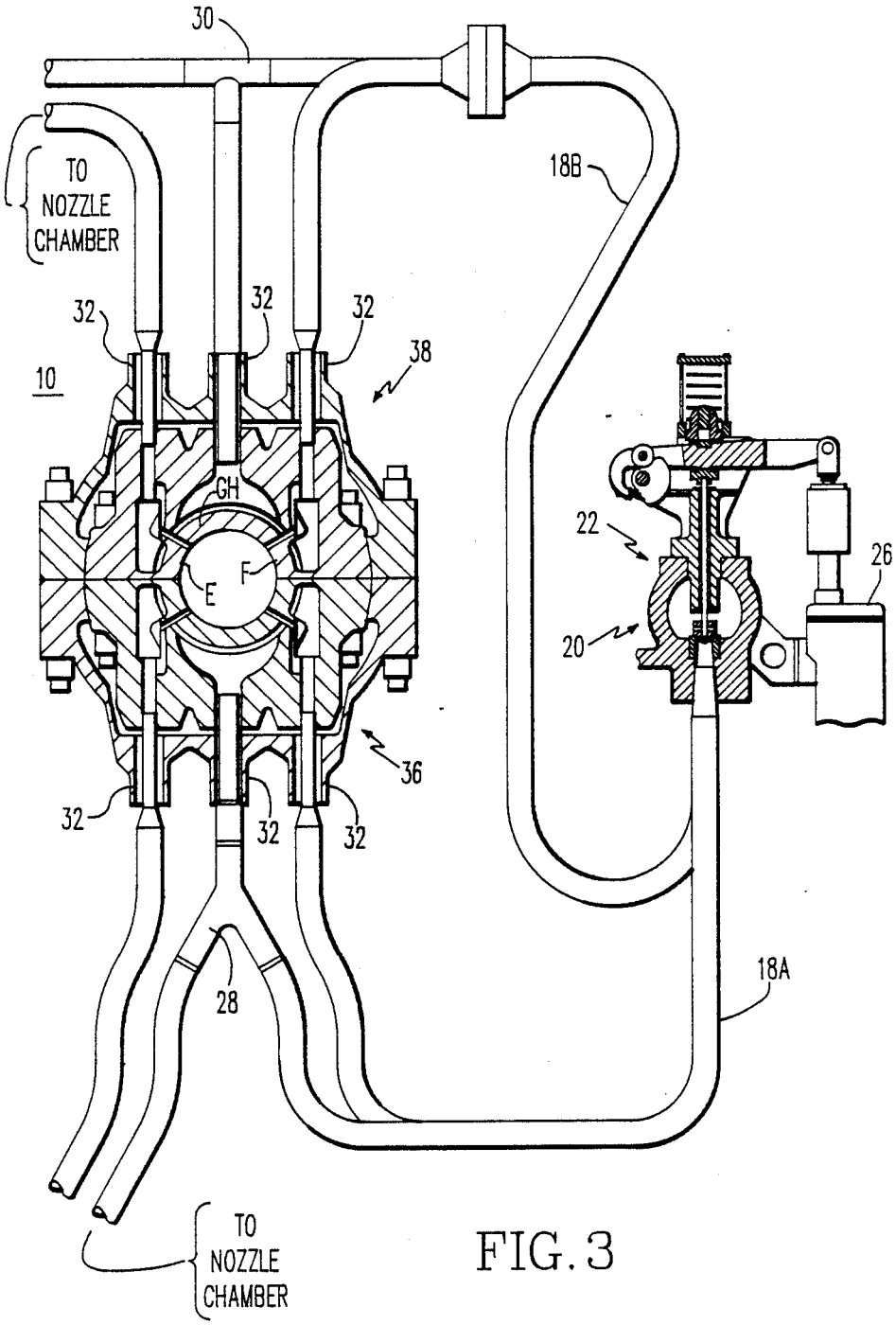
FIG. 3 is a simplified cross-sectional view of an eight-valve turbine with nozzle chamber and piping thereto showing an arrangement proposed to be eliminated by the present invention.

FIG. 3 is a partial cross-sectional view of an exemplary prior art steam turbine 10 and illustrates the arrangement of steam supply lines 18A, 18B for supplying steam to the nozzle chambers such as are shown in FIG. 2. Also shown is a steam chest 20, governor valve 22 and servomotor assembly 26. The turbine 10 utilizes an expensive Y fitting 28 and a T fitting 30 for reducing the number of inlet snouts 32 to one each for the larger ones (BC and GH) of the nozzle chambers.

In the conventional arrangement of "spaghetti" piping (steam supply line 18) leading to inlet snouts 32 from steam chest 20, there are eight supply lines: four conduits 18A leading to nozzle chambers in the lower casing 36 and four conduits 18B leading to the nozzle chambers in the upper casing 38. As can be easily seen, conduits 18B have two more 90° bends than conduits 18A. The elimination of these bends and the downward detour of conduits 18B are important elements of the present invention. While FIG. 3 shows only the steam chest 20, valve 22 and servomotor assembly 26 for the right hand side of turbine 10, it will be appreciated that identical elements are located on the left hand side of the turbine.

Figure 4:
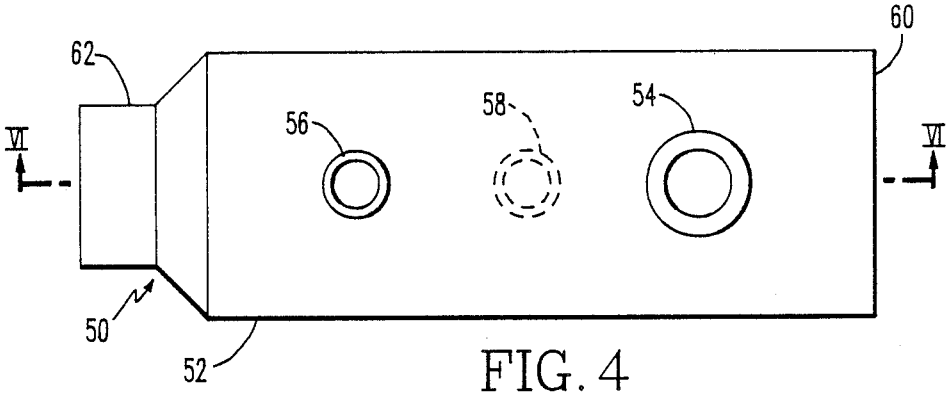
FIG. 4 is a plan view of a steam chest in accordance with the teachings of the present invention.

FIG. 4 is a simplified plan view of a novel steam chest 50 in accordance with the teachings of the present invention. In place of an eight-valve design with two four-valve steam chests, the present invention employs two steam chests 50 each having three governor valves (not shown) and three outlet ports 54, 56 and 58. One of these ports 54 is larger than a conventional port, such as port 56, and regulates flow to the single one of the snouts 32 coupled to one of the larger nozzle chambers BC or GH of the turbine casing. Preferably, the port 54 is located near the closed end 60 of a corresponding one of the steam chests 50. The smaller valves 56 and 58 supply the smaller nozzle chambers A, D, E and F. The reduction in the number of governor valves 22 does not impair the optimum sequencing of nozzle chamber activation described herein. As previously mentioned, the prior art for eight-valve designs typically uses the nozzle chamber configuration of FIG. 2, and the two valves supplying each of the larger chambers BC and GH were opened and closed in unison. The port 54 and corresponding valves are sized to provide the equivalent steam flow obtained from the prior dual valve system. Port 62 represents a steam inlet port. The control or governor valves 22 may be connected to this chest design in essentially the same manner as shown in FIG. 3, noting that each valve has its own servomotor and that the servomotors for the valves in ports 54, 56 may be inverted.

Figure 5:
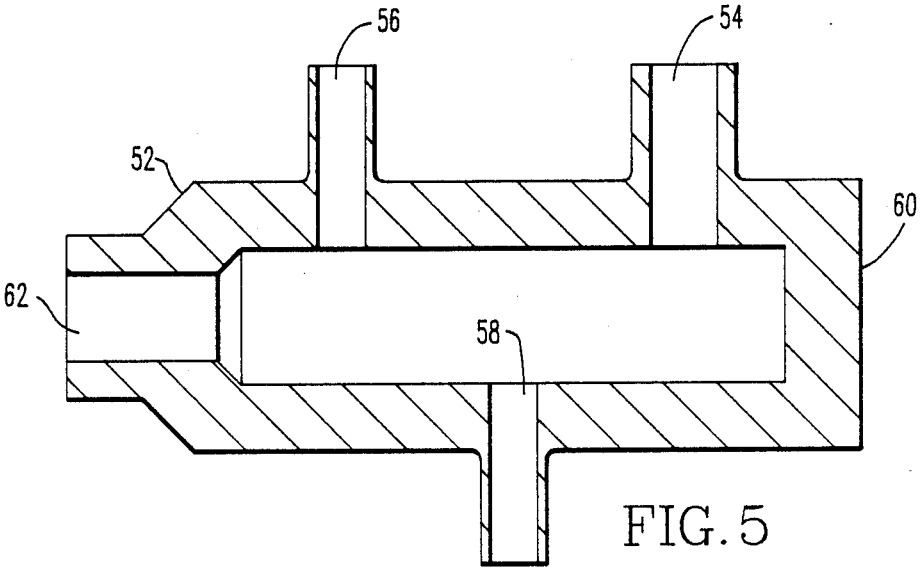
FIG. 5 is a cross-sectional view of the steam chest of FIG. 4 taken along lines 5—5.

FIG. 5 is a cross-sectional view of steam chest 50 taken along line 5—5 of FIG. 4. The steam chest 50 is designed such that the larger outlet port 54 and one of the smaller ports 56 are positioned to permit steam flow in one vertical direction. The remaining smaller port 58 is positioned intermediate the ports 54 and 56 on an opposite side of chest 50 for directing steam flow in an opposite vertical direction. Ports 54, 56 and their associated valves (not shown) control steam flow to nozzle chambers in the upper casing 38 while port 58 and its associated valve (not shown) controls flow to a smaller chamber in the lower casing 36. The smaller chambers D and F, served by the smaller ports 56, 58, respectively, are situated on the same side of the turbine 10 as is the steam chest 50 shown in FIG. 4. A mirror image of this steam chest (not shown) is situated on the opposite side of the steam turbine, with a converse arrangement of ports, i.e., two ports—one large and one small—opening downward, and a small port in the middle opening upward.

This novel steam chest arrangement eliminates several expensive design features. For example, it reduces the number of steam governor valves 22 from eight to six and reduces the number of steam supply lines 18 between steam chest and nozzle chambers from eight to six. The larger port 54 obviates the need for the Y and T fittings since double supply lines are not required. It also eliminates the 180° turn in the supply line 18B leading from steam chest 50 to nozzle chambers in the upper casing.

Figure 6:
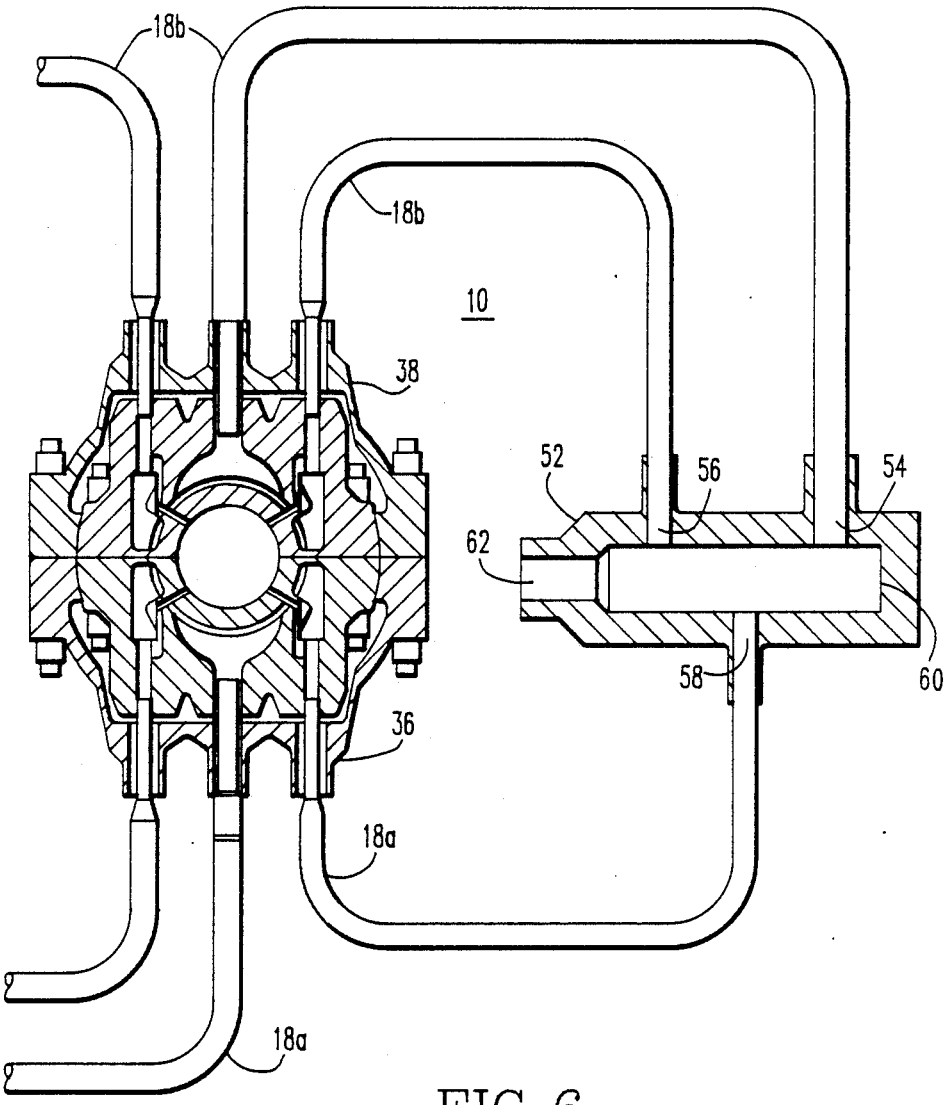
FIG. 6 is a simplified cross-sectional view of a steam turbine taken through the first stage nozzle chambers and showing steam supply lines arranged in accordance with the present invention.

FIG. 6 shows the new simplified configuration of "spaghetti" piping made possible by the present invention. Not only is the total number of steam supply lines 18 reduced, but the supply lines follow a more direct route from the inverted ports in steam chests 50. Note that the steam lines 18A, 18B on the left side of turbine 10 connect to a left side steam inlet chest (not shown) in the same manner as for the right side connections to chest 50. While the steam governor valves equivalent to valve 22 of FIG. 3 are not shown in the ports 54, 56 and 58, it will be recognized that each of the ports is provided with a governor valve 22 of corresponding size and that each each valve is controlled by a controller 26 connected substantially as shown in FIG. 3.

While the principles of the invention have now been made clear in an illustrative embodiment, it will become apparent to those skilled in the art that many modifications of the structures, arrangements and components presented in the above illustrations may be made in the practice of the invention in order to develop alternate embodiments without departing from the scope and principles of the invention as set forth in the claims which follow. For example, a four valve machine can be made to operate at essentially the same efficiency as a conventional six valve machine by providing two 33.33 percent arcs of admission and two 16.67 percent arcs of admission. Referring to FIG. 1, the four valve machine could be operated to follow curve 14 with valve points at 50%, 66.67%, 83.33% and 100%.

What is claimed is:

1. An improved method of admitting steam into a steam turbine having an upper casing and a lower casing with a large nozzle chamber and at least one small nozzle chamber in each of the casings through which steam is admitted into the turbine, the method comprising the steps of:

controlling steam flow to each nozzle chamber with a single correspondingly-sized steam supply port and associated valve in a steam chest;

orienting adjacent ones of the steam supply ports in opposite directions within the steam chest so that steam flow destined for nozzle chambers in the upper casing is directed upwardly, and steam flow destined for nozzle chambers in the lower casing is directed downwardly; and connecting each of the ports to its corresponding nozzle chamber with a single pipe means and an inlet pipe.

2. The method according to claim 1 wherein the step of controlling steam flow includes the step of actuating a separate, independently controllable servomotor operatively coupled to a corresponding one of the valves.

3. The method according to claim 1 further comprising the steps of incrementally admitting steam into the turbine in the following order:

admitting steam into one of the larger nozzle chambers and at least one adjacent smaller nozzle chamber to achieve an initial arc of admission of at least fifty percent;

serially admitting steam to each of the remaining ones of the smaller nozzle chambers with increasing load on the turbine;

admitting steam into the remaining larger nozzle chamber while simultaneously stopping steam flow to the remaining ones of the smaller nozzle chambers with increasing load on the turbine; and serially admitting steam into the remaining ones of the smaller nozzle chambers with increasing load on the turbine.

4. The method of claim 3 further comprising the step of admitting steam equally from a left side steam chest and a right side steam chest such that the nozzle chambers comprising the initial arc of admission draw approximately balanced flows of steam from each of the steam chests.

5. An improved system for admitting steam into a steam turbine comprising:

a steam turbine having an upper casing and a lower casing, each of said casings having a single large nozzle chamber circumferentially adjacent to at least one smaller nozzle chamber through which chambers steam may enter said turbine;

a single, correspondingly-sized valve means for controlling steam flow into each of said nozzle chambers;

steam chest means in which said valve means are grouped in alternately opposed directions, such that those ones of said valves controlling steam to nozzle chambers situate in said upper casing open to provide upwardly directed steam flow, and those valve means controlling steam to said lower casing open to provide downwardly directed flow;

a single correspondingly-sized inlet snout into each of said nozzle chambers; and a single pipe means connecting each inlet snout to its corresponding valve means.

6. The system according to claim 5 further comprising a plurality of independently actuated servomotors, each of said servomotors controlling activation of a corresponding one of said valves.

7. The system according to claim 5 wherein said steam chest means comprises a left steam chest and a right steam chest, said valves being divided between the left and right chests in such an arrangement that when a partial-arc of steam admission is activated through circumferentially adjacent nozzle chambers, there is an approximate balance between the respective steam flows coming from the left and right chests.

8. The system according to claim 5 wherein said steam chest means comprises single-ended steam chests having a steam inlet end and a closed end, the improvement further comprising placing the larger valve controlling steam flow to said larger nozzle chamber at said closed end.

* * * * *